US011776476B2

(12) United States Patent
Lee et al.

(10) Patent No.: US 11,776,476 B2
(45) Date of Patent: Oct. 3, 2023

(54) PIXEL CIRCUIT AND DISPLAY DEVICE INCLUDING THE SAME

(71) Applicant: LG Display Co., Ltd., Seoul (KR)

(72) Inventors: Hyun Soo Lee, Paju-si (KR); Yong Won Lee, Paju-si (KR); Seo Jun Yeom, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/839,174

(22) Filed: Jun. 13, 2022

(65) Prior Publication Data

US 2023/0012381 A1 Jan. 12, 2023

(30) Foreign Application Priority Data

Jul. 8, 2021 (KR) ..... 10-2021-0089955
Dec. 8, 2021 (KR) ..... 10-2021-0174570

(51) Int. Cl.
*G09G 3/3233* (2016.01)
*G09G 3/3266* (2016.01)
*G09G 3/3283* (2016.01)

(52) U.S. Cl.
CPC ..... *G09G 3/3233* (2013.01); *G09G 3/3266* (2013.01); *G09G 3/3283* (2013.01); *G09G 2300/0426* (2013.01); *G09G 2300/0819* (2013.01); *G09G 2300/0842* (2013.01); *G09G 2310/0297* (2013.01); *G09G 2310/08* (2013.01); *G09G 2320/04* (2013.01); *G09G 2330/021* (2013.01)

(58) Field of Classification Search
CPC .. G09G 3/3225; G09G 3/3233; G09G 3/3266; G09G 3/3283; G09G 2300/0426; G09G 2300/0819; G09G 2300/0842; G09G 2310/0251; G09G 2310/0297; G09G 2310/08; G09G 2320/0247; G09G 2320/04; G09G 2330/021
See application file for complete search history.

(56) References Cited

U.S. PATENT DOCUMENTS

| | | | | |
|---|---|---|---|---|
| 10,181,291 | B2 * | 1/2019 | Han | G09G 3/3233 |
| 2009/0121974 | A1 * | 5/2009 | Yamashita | G09G 3/3266 345/55 |
| 2017/0116918 | A1 * | 4/2017 | Dong | G09G 3/20 |
| 2017/0316738 | A1 * | 11/2017 | Sohn | G09G 3/3275 |
| 2018/0330670 | A1 * | 11/2018 | Han | G09G 3/3233 |
| 2019/0355802 | A1 * | 11/2019 | Shim | H10K 59/121 |

* cited by examiner

*Primary Examiner* — Michael Pervan
(74) *Attorney, Agent, or Firm* — Fenwick & West LLP

(57) ABSTRACT

A pixel circuit and a display device including the same are disclosed. The pixel circuit includes a driving element including a first electrode connected to a first node to which a pixel driving voltage is applied, a gate electrode connected to a second node, and a third electrode connected to a third node; a light emitting element including an anode electrode connected to the third node, and a cathode electrode to which a pixel ground voltage supply voltage is applied; a first switch element configured to supply a data voltage to the second node in response to a scan pulse; and a second switch element configured to supply a first initialization voltage set to a negative voltage that is less than the pixel ground voltage supply voltage to the third node in response to a first initialization pulse.

13 Claims, 9 Drawing Sheets

PIXEL CIRCUIT AND DISPLAY DEVICE INCLUDING THE SAME

CROSS-REFERENCE TO RELATED APPLICATIONS

This application claims priority to and the benefit of Republic of Korea Patent Application No. 10-2021-0089955, filed on Jul. 8, 2021 and Republic of Korea Patent Application No. 10-2021-0174570, filed on Dec. 8, 2021, each of which is incorporated by reference in its entirety.

FIELD

The present disclosure relates to a pixel circuit and a display device including the same.

BACKGROUND

An electroluminescence display device may be divided into an inorganic light emitting display device and an organic light emitting display device according to the material of the emission layer. The active matrix type organic light emitting display device includes an organic light emitting diode (hereinafter, referred to as "OLED") that emits light, and has the advantage of fast response speed, high light-emitting efficiency, high luminance and viewing angle. In the organic light emitting display device, OLED (organic light emitting diode) is formed in each pixel. The organic light emitting display device has a fast response speed, excellent light-emitting efficiency, luminance, and viewing angle, and has also excellent contrast ratio and color reproducibility because black gray scale can be expressed as complete black.

A pixel circuit of an organic light emitting display device includes a light emitting element, a driving element for driving the light emitting element, and one or more switch elements. The switch elements are turned on/off according to the gate voltage to connect or block main nodes of the pixel circuit. The driving element and the switch elements may be implemented as transistors.

The pixel circuit of the organic light emitting display device may include an initialization stage. In the initialization stage, the source node voltage of the driving element may be initialized to a positive voltage higher than 0 V for example. In this case, the pixel ground voltage supply voltage applied to the cathode electrode of the light emitting element needs to use a voltage equal to or higher than the source node voltage. This causes an increase in power consumption of the display device.

A pixel ground voltage supply voltage is commonly applied to the pixels of the organic light emitting display device. A ripple may occur in the pixel ground voltage supply voltage when the data voltage is changed or the voltage of the source node is changed through the parasitic capacitance of the display panel and the capacitance of the light emitting element. In this case, the current flowing through the light emitting element may be changed, which, in turn, may result in the change in the luminance of the pixels. For example, when an input image including a crosstalk pattern is displayed on the screen of the display panel, and when a ripple occurs in a pixel ground voltage supply voltage, line dim or block dim may become visible. When the voltage of the source node and the pixel ground voltage supply voltage are set to a voltage of 0V for example or higher, the ripple of the pixel ground voltage supply voltage may increase.

SUMMARY

This disclosure has been made in an effort to address at least one of aforementioned necessities and/or drawbacks.

This disclosure provides a pixel circuit capable of preventing image quality deterioration due to a ripple of a pixel ground voltage supply voltage commonly applied between pixels, and a display device including the same.

The drawbacks which this disclosure addresses are not limited to the aforementioned ones, but other drawbacks which can be solved by this disclosure will become apparent to those skilled in the art from the description below.

A pixel circuit according to an embodiment of this disclosure includes a driving element including a first electrode connected to a first node to which a pixel driving voltage is applied, a gate electrode connected to a second node, and a third electrode connected to a third node, and configured to supply an electric current to a light emitting element; the light emitting element including an anode electrode connected to the third node, and a cathode electrode to which a pixel ground voltage supply voltage is applied; and a switch element configured to supply a first initialization voltage set to a negative voltage lower than the pixel ground voltage supply voltage to the third node in response to a first initialization pulse.

A pixel circuit according to an embodiment of this disclosure includes a driving element including a first electrode connected to a first node to which a pixel driving voltage is applied, a gate electrode connected to a second node, and a third electrode connected to a third node, and supplying an electric current to a light emitting element; a light emitting element including an anode electrode connected to the third node, and a cathode electrode to which a pixel ground voltage supply voltage is applied; a first switch element supplying a data voltage to the second node in response to a scan pulse; a second switch element supplying a first initialization voltage set to a negative voltage lower than the pixel ground voltage supply voltage to the third node in response to a first initialization pulse; a third switch element supplying a second initialization voltage higher than the first initialization voltage to the second node in response to a second initialization pulse; and a capacitor connected between the second node and the third node.

The display device according to an embodiment of this disclosure includes the pixel circuit.

According to according to an embodiment of this disclosure, the pixel ground voltage supply voltage may be set to 0 V or the ground voltage (GND) for example by initializing the source node of the driving element to a negative voltage. As a result, according to this disclosure, power consumption of the display panel can be reduced, and the ripple of the pixel ground voltage supply voltage can be minimized. Additionally, according to this disclosure, the data voltage Vdata can be lowered, so that the power consumption can be reduced.

According to according to an embodiment of this disclosure, it is possible to generate a negative voltage in the display panel without adding a negative voltage generating circuit to a power supply.

Effects of the present disclosure are not limited to the effects mentioned above, and other effects not mentioned above will be clearly appreciated by those skilled in the art from the appended claims.

BRIEF DESCRIPTION OF DRAWINGS

The above and other objects, features and advantages of the present invention will become more apparent to those skilled in the art by describing exemplary embodiments thereof in detail with reference to the accompanying drawings, in which.

DETAILED DESCRIPTION

Figure 1:
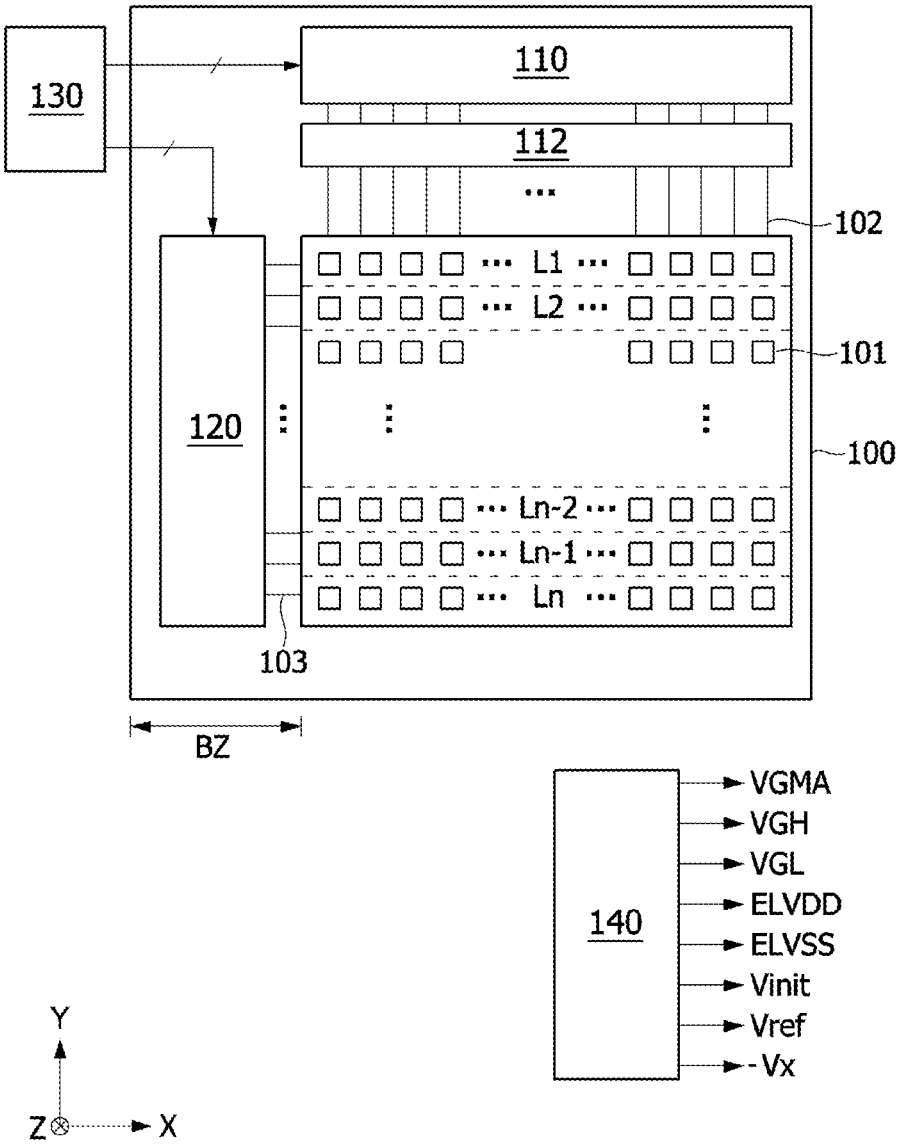
FIG. 1 is a block diagram showing a display device according to an embodiment of this disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," "having," and "comprising" used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The same reference numerals may refer to substantially the same elements throughout the present disclosure.

The following embodiments can be partially or entirely bonded to or combined with each other and can be linked and operated in technically various ways. The embodiments can be carried out independently of or in association with each other.

Each of the pixels may include a plurality of sub-pixels having different colors to in order to reproduce the color of the image on a screen of the display panel. Each of the sub-pixels includes a transistor used as a switch element or a driving element. Such a transistor may be implemented as a TFT (thin film transistor).

A driving circuit of the display device writes a pixel data of an input image to pixels on the display panel. To this end, the driving circuit of the display device may include a data driving circuit configured to supply data signal to the data lines, a gate driving circuit configured to supply a gate signal to the gate lines, and the like.

In a display device of the present disclosure, the pixel circuit and the gate driving circuit may include a plurality of transistors. Transistors may be implemented as oxide thin film transistors (oxide TFTs) including an oxide semiconductor, low temperature polysilicon (LTPS) TFTs including low temperature polysilicon, or the like. In the embodiments described herein, description are given based on an example in which the transistors of the pixel circuit and the gate driving circuit are implemented as the n-channel oxide TFTs, but the present disclosure is not limited thereto.

A transistor is a three-electrode element including a gate, a source, and a drain. The source is an electrode that supplies carriers to the transistor. In the transistor, carriers start to flow from the source. The drain is an electrode through which carriers exit from the transistor. In a transistor, carriers flow from a source to a drain. In the case of an n-channel transistor, since carriers are electrons, a source voltage is a voltage lower than a drain voltage such that electrons may flow from a source to a drain. The n-channel transistor has a direction of a current flowing from the drain to the source. In the case of a p-channel transistor (p-channel metal-oxide semiconductor (PMOS)), since carriers are holes, a source voltage is higher than a drain voltage such that holes may flow from a source to a drain. In the p-channel transistor, since holes flow from the source to the drain, a current flows from the source to the drain. It should be noted that a source and a drain of a transistor are not fixed. For example, a source and a drain may be changed according to an applied voltage. Therefore, the disclosure is not limited due to a source and a drain of a transistor. In the following description, a source and a drain of a transistor will be referred to as a first electrode and a second electrode.

A gate signal swings between a gate-on voltage and a gate-off voltage. The gate-on voltage is set to a voltage higher than a threshold voltage of a transistor, and the gate-off voltage is set to a voltage lower than the threshold voltage of the transistor.

The transistor is turned on in response to the gate-on voltage and is turned off in response to the gate-off voltage.

In the case of an n-channel transistor, a gate-on voltage may be a gate high voltage, and a gate-off voltage may be a gate low voltage.

Hereinafter, various embodiments of this disclosure will be described with reference to the accompanying drawings. In the following embodiments, the display device will be described mainly with respect to the organic light emitting display device, but this disclosure is not limited thereto. Also, the scope of this disclosure is not intended to be limited by the names of components or signals in the following embodiments and claims.

Figure 2:
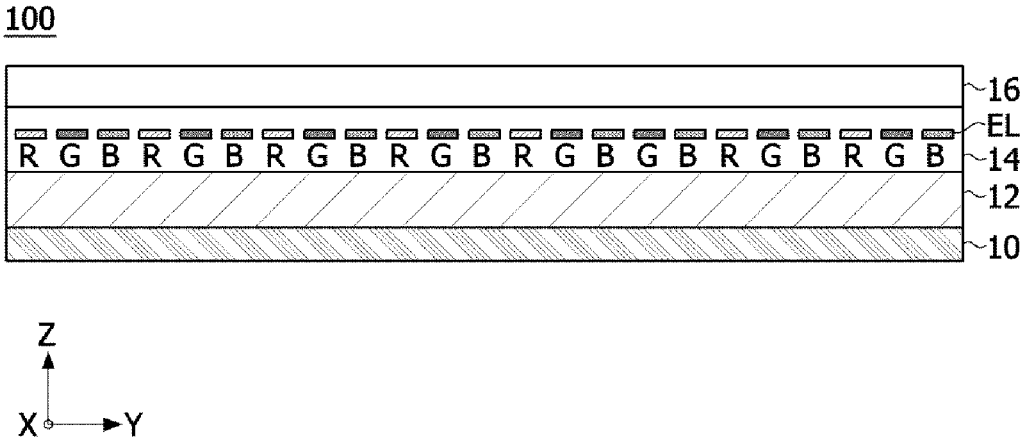
FIG. 2 is a cross-sectional view showing a cross-sectional structure of the display panel shown in FIG. 1 according to an embodiment of this disclosure.

Referring to FIGS. 1 and 2, a display device according to an embodiment of this disclosure includes a display panel 100, a display panel driver for writing pixel data to pixels of the display panel 100, and a power supply 140 for generating power required to drive the pixels and the display panel driver.

The display panel 100 may be a panel having a rectangular structure with a length in the X-axis direction, a width in the Y-axis direction, and a thickness in the Z-axis direction. The display panel 100 includes a pixel array that displays an input image on a screen. The pixel array includes a plurality of data lines 102, a plurality of gate lines 103 crossing the data lines 102, and pixels arranged in a matrix form. The display panel 100 may further include power lines commonly connected to the pixels. The power lines supply a substantially constant voltage required for driving the pixels 101 to the pixels 101. For example, the display panel 100 may include a VDD line to which a pixel driving voltage ELVDD is applied and a VSS line to which a pixel ground voltage supply voltage ELVSS is applied. In addition, the power lines may further include a REF line to which a reference voltage Vref is applied, an INIT1 line to which a first initialization voltage −Vx is applied, an INIT2 line to which a second initialization voltage Vinit is applied, and the like.

As shown in FIG. 2, the cross-sectional structure of the display panel 100 may include a circuit layer 12 stacked on a substrate 10, a light emitting element layer 14, and an encapsulation layer 16 according to an embodiment.

The circuit layer 12 may include a TFT array including a pixel circuit connected to wires such as a data line, a gate line, a power line, and the like, a de-multiplexer array 112, a gate driver 120 and the like. The wire and circuit elements of the circuit layer 12 may include a plurality of insulating layers, two or more metal layers separated with the insulating layer therebetween, and an active layer including a semiconductor material. All transistors formed in the circuit layer 12 may be implemented as n-channel oxide TFTs.

The light emitting element layer 14 may include a light emitting element EL driven by the pixel circuit. The light emitting element EL may include a red (red, R) light emitting element, a green (green, G) light emitting element, and a blue (blue, B) light emitting element. In another embodiment, the light emitting element layer 14 may include a white light emitting element and a color filter. The light emitting elements EL of the light emitting element layer 14 may be covered by a multi-layered protective layer including an organic film and an inorganic protective film.

The encapsulation layer 16 covers the light emitting element layer 14 to seal the circuit layer 12 and the light emitting element layer 14. The encapsulation layer 16 may also have a multi-insulating film structure in which an organic film and an inorganic film are alternately stacked. The inorganic film blocks or at least reduces permeation of moisture and oxygen. The organic film planarizes the surface of the inorganic film. When the organic layer and the inorganic layer are stacked in multiple layers, the movement path of moisture or oxygen becomes longer than that of a single layer, so that penetration of moisture and oxygen affecting the light emitting element layer 14 can be effectively blocked or at least reduced.

A touch sensor layer omitted from the drawing may be formed on the encapsulation layer 16, and a polarizer or a color filter layer may be disposed thereon. The touch sensor layer may include capacitive touch sensors that sense a touch input based on a change in capacitance before and after the touch input. The touch sensor layer may include insulating layers and metal wire patterns forming the capacitance of the touch sensors. The insulating layers may insulate the crossing portions of the metal wire patterns, and may planarize the surface of the touch sensor layer. The polarizer may improve visibility and contrast ratio by converting the polarization of external light reflected by the metal of the touch sensor layer and the circuit layer. The polarizer may be implemented as a polarizer or a circular polarizer to which a linear polarizer and a phase retardation film are bonded. A cover glass may be adhered to the polarizer. The color filter layer may include red, green, and blue color filters. The color filter layer may further include a black matrix pattern. The color filter layer absorbs a portion of the wavelength of light reflected from the circuit layer and the touch sensor layer, so that it can replace the polarizer and increase the color purity of the image reproduced in the pixel array.

The pixel array includes a plurality of pixel lines L1 to Ln. Each of the pixel lines L1 to Ln includes one line of pixels arranged along the line direction (X-axis direction) in the pixel array of the display panel 100. The pixels arranged in one pixel line share gate lines 103. Sub-pixels arranged in the column direction Y along the data line direction share the same data line 102. One horizontal period is a time obtained by dividing one frame period by the total number of pixel lines L1 to Ln.

The display panel 100 may be implemented as a non-transmissive display panel or a transmissive display panel. The transmissive display panel may be applied to a transparent display device in which an image is displayed on a screen and an actual background is visible. The display panel 100 may be manufactured as a flexible display panel.

Each of the pixels 101 may be divided into a red sub-pixel, a green sub-pixel, and a blue sub-pixel to implement color. Each of the pixels may further include a white sub-pixel. Each of the sub-pixels includes a pixel circuit. Hereinafter, a pixel may be interpreted as having the same meaning as a sub-pixel. Each of the pixel circuits is connected to data lines, gate lines, and power lines.

The pixels may be arranged as real color pixels and pentile pixels. The pentile pixel may implement a higher resolution than a real color pixel by driving two sub-pixels having different colors as one pixel 101 using a preset pixel rendering algorithm. The pixel rendering algorithm may compensate for insufficient color representation in each pixel with the color of light emitted from an adjacent pixel.

The power supply 140 generates a direct current (DC) voltage (or a constant voltage) required for driving the pixel array of the display panel 100 and the display panel driver by using a DC-DC converter. The DC-DC converter may include a charge pump, a regulator, a buck converter, a boost converter, and the like. The power supply 140 may generate DC voltage (or constant voltage) such as the gamma reference voltage VGMA, gate-on voltage VGH, gate-off voltage VGL, pixel driving voltage ELVDD, pixel ground voltage supply voltage ELVSS, first initialization voltage −Vx, second initialization voltage Vinit, reference voltage Vref, or the like by adjusting the level of the DC input voltage applied from the host system (not shown). The gamma reference voltage VGMA is supplied to the data driver 110. The gate-on voltage VGH and the gate-off voltage VGL are supplied to the gate driver 120. The constant voltage such as pixel driving voltage ELVDD, pixel ground voltage supply voltage ELVSS, first initialization voltage −Vx, second initialization voltage Vinit, reference voltage Vref, or the like is supplied to the pixels 101 through power lines commonly connected to the pixels 101. The constant voltages applied to the pixel circuit may have different voltage levels.

The first initialization voltage −Vx may be generated from the negative voltage generating circuit. The negative voltage generating circuit may be disposed on the display panel 100 without the need of being added to the power supply 140.

The display panel driver writes the pixel data of the input image to the pixels of the display panel 100 under the control of the timing controller 130.

The display panel driver includes the data driver 110 and the gate driver 120. The display panel driver may further include a de-multiplexer array 112 disposed between the data driver 110 and the data lines 102.

The de-multiplexer array 112 sequentially supplies the data voltages outputted from the channels of the data driver 110 to the data lines 102 using a plurality of de-multiplexers (DEMUX). The de-multiplexer may include a multiple of switch elements disposed on the display panel 100. When the de-multiplexer is disposed between the output terminals of the data driver 110 and the data lines 102, the number of channels of the data driver 110 may be reduced. The de-multiplexer array 112 may be omitted.

The display panel driver may further include a touch sensor driver for driving the touch sensors. The touch sensor driver is omitted from FIG. 1. The data driver 110 and the touch sensor driver may be integrated into one drive IC (integrated circuit). In a mobile device or a wearable device, the timing controller 130, the power supply 140, the data driver 110, and the like may be integrated into one drive IC.

The display panel driver may operate in a low speed driving mode under the control of the timing controller 130. The low speed driving mode may be set to reduce power consumption of the display device when the input image does not change by a preset number of frames by analyzing the input image. In the low speed driving mode, the power consumption of the display panel driver and the display panel 100 may be reduced by lowering a refresh rate of pixels when a still image is inputted for a predetermined time or longer. The low speed driving mode is not limited to when a still image is input. For example, when the display device operates in the standby mode or when a user command or an input image is not inputted to the display panel driver for a predetermined time or more, the display panel driver may operate in the low speed driving mode.

The data driver 110 receives pixel data of an input image received as a digital signal from the timing controller 130 and outputs a data voltage. The data driver 110 generates a data voltage Vdata by converting pixel data of an input image into a gamma compensation voltage every frame period using a digital to analog converter (DAC). The gamma reference voltage VGMA is divided into a gamma compensation voltage for each gray scale through a voltage divider circuit. The gamma compensation voltage for each gray level is provided to the DAC of the data driver 110. The data voltage Vdata is outputted from each of the channels of the data driver 110 through an output buffer.

The gate driver 120 may be implemented as a gate in panel (GIP) circuit formed in the circuit layer 12 on the display panel 100 together with the TFT array and wires of the pixel array. The gate driver 120 may be disposed on a bezel BZ, which is a non-display region of the display panel 100, or may be distributed in a pixel array in which an input image is reproduced. The gate driver 120 sequentially outputs the gate signal to the gate lines 103 under the control of the timing controller 130. The gate driver 120 may sequentially supply the gate signals to the gate lines 103 while shifting the gate signals using a shift register. The gate signal may include various gate pulses such as a scan pulse, a sensing pulse, an initialization pulse, a light emitting control pulse (hereinafter, referred to as an "EM pulse") and the like.

The timing controller 130 receives digital video data DATA of an input image from the host system, and a timing signal synchronized with the digital video data DATA. The timing signal may include a vertical synchronization signal Vsync, a horizontal synchronization signal Hsync, a clock CLK, and a data enable signal DE. Since the vertical period and the horizontal period can be known by means of counting the data enable signal DE, the vertical synchronization signal Vsync and the horizontal synchronization signal Hsync may be omitted. The data enable signal DE has a period of one horizontal period (1H).

The host system may be any one of a TV (television) system, a tablet computer, a notebook computer, a navigation system, a personal computer (PC), a home theater system, a mobile device, a wearable device, and a vehicle system. The host system may scale the image signal from the video source to fit the resolution of the display panel 100, and may transmit it to the timing controller 130 together with the timing signal.

The timing controller 130 may multiply the input frame frequency by i (i is a natural number) in the normal driving mode, so that it can control the operation timing of the display panel driver at a frame frequency of the input frame frequency×i Hz. The input frame frequency is 60 Hz in the NTSC (National Television Standards Committee) scheme, while it is 50 Hz in the PAL (phase-alternating line) scheme.

The timing controller 130 lowers (e.g., reduces) a frequency of a frame rate at which pixel data is written to pixels in the low speed driving mode compared to the normal driving mode. For example, in the normal driving mode, a data refresh frame frequency at which pixel data is written to pixels may occur at a frequency of 60 Hz or higher, for example, at a refresh rate of any one of 60 Hz, 120 Hz, and 144 Hz, and the data refresh frame DRF in the low speed driving mode may occur at a refresh rate of a lower frequency than that of the normal driving mode. The timing controller 130 may lower the driving frequency of the display panel driver by lowering the frame frequency to a frequency between 1 Hz and 30 Hz in order to lower the refresh rate of pixels in the low speed driving mode.

The timing controller 130 generates a data timing control signal for controlling the operation timing of the data driver 110 based on the timing signals Vsync, Hsync, DE received from the host system, a control signal for controlling the operation timing of the de-multiplexer array 112, and a gate timing control signal for controlling the operation timing of the gate driver 120. The timing controller 130 controls the operation timing of the display panel driver to synchronize the data driver 110, the de-multiplexer array 112, the touch sensor driver, and the gate driver 120.

The gate timing control signal generated from the timing controller 130 may be inputted to the shift register of the gate driver 120 through a level shifter (not shown). The level shifter may receive the gate timing control signal, generate a start pulse and a shift clock, and provide them to the shift register of the gate driver 120.

Figure 3:
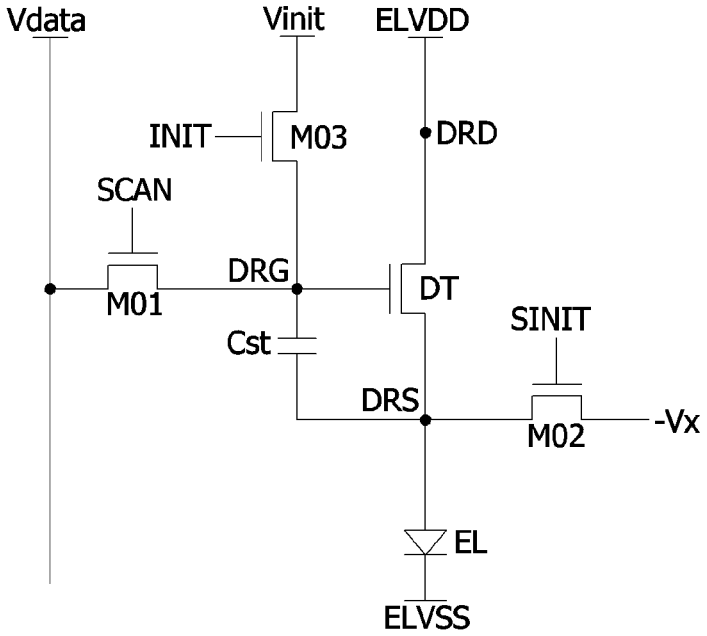
FIG. 3 is a circuit diagram showing a pixel circuit according to a first embodiment of this disclosure.
Figure 4:
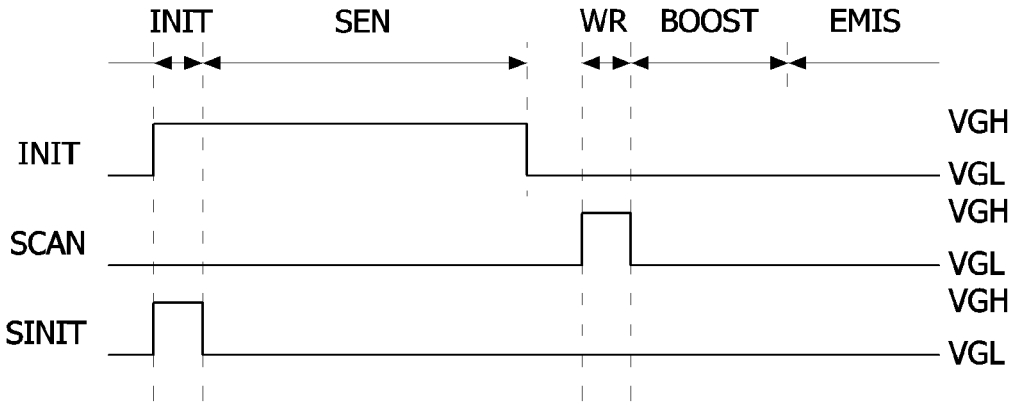
FIG. 4 is a waveform diagram showing a gate signal applied to the pixel circuit shown in FIG. 3 according to the first embodiment of this disclosure.

FIG. 3 is a circuit diagram showing a pixel circuit according to a first embodiment of this disclosure. FIG. 4 is a waveform diagram showing a gate signal applied to the pixel circuit shown in FIG. 3 according to the first embodiment of this disclosure.

Referring to FIGS. 3 and 4, the pixel circuit includes a light emitting element EL, a driving element DT for supplying electric current to the light emitting element EL, a plurality of switch elements M01 to M03, and a capacitor Cst. In this pixel circuit, the driving element DT and the switch elements M01 to M03 may be implemented as n-channel oxide TFTs.

A constant voltage, such as a pixel driving voltage ELVDD, a pixel ground voltage supply voltage ELVSS, a first initialization voltage −Vx, a second initialization voltage Vinit, or the like, is applied to the pixel circuit. The pixel driving voltage ELVDD is higher than the pixel ground voltage supply voltage ELVSS. The pixel ground voltage supply voltage ELVSS is set to 0 V or the ground voltage GND. The second initialization voltage Vinit is set to a voltage higher (e.g., greater) than the first initialization voltage −Vx. The first initialization voltage −Vx may be set to a negative voltage lower (e.g., less) than the pixel ground voltage supply voltage ELVSS. The gate-on voltage VGH may be set to a voltage higher than the pixel driving voltage ELVDD. The gate-off voltage VGL may be set to a voltage lower than the pixel ground voltage supply voltage ELVSS.

The pixel circuit may be driven in an internal compensation mode. In the internal compensation mode, the driving period of the pixel circuit may be divided into an initialization stage INIT, a sensing stage SEN, an addressing stage WR, a boosting stage BOOST, and a light emitting stage EMIS. In the initialization stage INIT, the second and third nodes DRG and DRS and the capacitor Cst of the pixel circuit are initialized, and the driving element DT is turned on. In the sensing stage SEN, when the voltage of the third node DRS rises and the gate-source voltage Vgs of the driving element DT becomes lower than the threshold voltage Vth, the driving element DT is turned off. The threshold voltage Vth of the driving element DT, which has been sampled when the driving element DT is turned off in the sensing stage SEN, is stored. When the data voltage Vdata is applied to the second node DRG in the addressing stage WR, the gate voltage of the driving element DT is changed to the data voltage Vdata compensated by the threshold voltage Vth. The voltages of the second node DRG and the third node DRS floating in the boosting stage BOOST rise, so that a capacitor connected between both ends of the light emitting element EL is charged. A capacitor connected between both ends of the light emitting element EL is omitted from the drawings. In the light emitting stage EMIS, the driving element DT generates an electric current for driving the light emitting element EL according to the gate-source voltage Vgs.

The gate driver 120 may include a first shift register sequentially outputting the first initialization pulses SINITs, a second shift register sequentially outputting the second initialization pulses INITs, and a third shift register that sequentially outputs the scan pulses SCANs.

The first initialization pulse SINIT is generated as the gate-on voltage VGH in the initialization stage INIT, while it is the gate-off voltage VGL in the sensing stage SEN, the addressing stage WR, the boosting stage BOOST, and the light emitting stage EMIS. The second initialization pulse INIT is generated as the gate-on voltage VGH in the initialization stage INIT and the sensing stage SEN. The second initialization pulse INIT is the gate-off voltage VGL in the addressing stage WR, the boosting stage BOOST, and the light emitting stage EMIS. The scan pulse SCAN is synchronized with the data voltage Vdata of the pixel data, and is generated as the gate-on voltage VGH in the addressing stage WR. The scan pulse SCAN is the gate-off voltage VGL in the initialization stage INIT, the sensing stage SEN, the boosting stage BOOST, and the light emitting stage EMIS.

The light emitting element EL may be implemented as an OLED including an anode electrode, a cathode electrode, and an organic compound layer connected between these electrodes. The organic compound layer includes, without limitation, a hole injection layer HIL, a hole transport layer HTL, an emission layer EML, an electron transport layer ETL, and an electron injection layer EIL. When a voltage is applied to the anode and cathode electrodes, holes passing through the hole transport layer HTL and electrons passing through the electron transport layer ETL move to the emission layer EML to form excitons. At this time, visible light may be emitted from the emission layer EML. The anode electrode of the light emitting element EL may be connected to the third node DRS, and the cathode electrode thereof may be connected to the VSS line to which the pixel ground voltage supply voltage ELVSS is applied. The OLED used as the light emitting element EL may have a tandem structure in which a plurality of emission layers are stacked. The tandem structure of OLED can improve the luminance and lifespan of pixels.

The driving element DT generates an electric current for driving the light emitting element EL according to the gate-source voltage Vgs. The driving element DT includes a gate electrode connected to the second node DRG, a first electrode connected to the first node DRD to which the pixel driving voltage ELVDD is applied, and a third electrode connected to the third node DRS. The capacitor Cst is connected between the second node DRG and the third node DRS.

The first switch element M01 is turned on according to the gate-on voltage VGH of the scan pulse SCAN to supply the data voltage Vdata to the second node DRG in the addressing stage WR. The first switch element M01 includes a gate electrode connected to the first gate line to which the scan pulse SCAN is applied, a first electrode connected to the data line to which the data voltage Vdata is applied, and a second electrode connected to the second node DRG.

The second switch element M02 is turned on according to the gate-on voltage VGH of the first initialization pulse SINIT to supply the first initialization voltage −Vx to the third node DRS in the initialization stage INIT. The second switch element M02 includes a gate electrode connected to a second gate line to which the first initialization pulse SINIT is applied, a first electrode connected to the third node DRS, and a second electrode connected to an INIT1 line to which the first initialization voltage −Vx is applied.

The third switch element M03 is turned on according to the gate-on voltage VGH of the second initialization pulse INIT to supply the second initialization voltage Vinit to the second node DRG in the initialization stage INIT and the sensing stage SEN. The third switch element M03 includes a gate electrode connected to a third gate line to which the second initialization pulse INIT is applied, a first electrode connected to the line to which the second initialization voltage Vinit is applied, and a second electrode connected to the second node DRG.

In this disclosure, the pixel ground voltage supply voltage ELVSS can be set to 0 V or the ground voltage GND by initializing the third node DRS of the pixel circuit to a negative voltage, that is, the first initialization voltage −Vx. As a result, according to this disclosure, power consumption of the display panel 100 can be reduced, and the ripple of the pixel ground voltage supply voltage ELVSS can be reduced. When the data voltage Vdata and the gate pulse change, the parasitic capacitance and the ripple component generated through the capacitor connected to both ends of the light emitting element EL are discharged to the VSS line with low resistance, thereby reducing the ripple of the pixel ground voltage supply voltage (ELVSS). In addition, according to this disclosure, since the data voltage Vdata can be used as a voltage lower than the data voltage when the pixel ground voltage supply voltage ELVSS is higher than 0 V, power consumption can be further reduced.

Due to device characteristic variations and process variations caused in the manufacturing process of the display panel 100, there may be differences in electrical characteristics of driving elements between pixels, and such differences may increase as driving time of the pixels elapses. In order to compensate for variations in electrical characteristics of the driving elements between pixels, an internal compensation circuit may be embedded in the pixel circuit or an external compensation circuit may be connected to the pixel circuit. The internal compensation circuit samples the electrical characteristics of the driving element for each sub-pixel using the internal compensation circuit implemented in each pixel circuit as shown in FIG. 3, and compensates for the gate-source voltage Vgs of the driving element by such electrical characteristics. The external compensation circuit compensates for the change in the electrical characteristics of the driving element by generating a compensation value based on a result of sensing the electrical characteristics of the driving element using the external compensation circuit connected to the pixel circuit.

The external compensation circuit includes a REF line (or sensing line) connected to the pixel circuit, and an analog to digital converter (ADC) that converts the sensing voltage stored in the REF line into digital data. The sensing voltage may include electrical characteristics of the driving element DT, for example, a threshold voltage and/or mobility. An integrator may be connected to the input terminal of the ADC. The timing controller 130 to which the external compensation circuit is applied may generate a compensation value for compensating for changes in the electrical characteristics of the driving element DT according to the sensed data input from the ADC, and may compensate for the change in the electrical characteristics of the driving element DT by adding or multiplying the compensation value to the pixel data of the input image. The ADC may be embedded in the data driver 110.

According to this disclosure, the pixel circuit can be driven by a hybrid driving method in which internal compensation and external compensation are combined. In this case, the normal driving mode may include an internal compensation mode and an external compensation mode. The threshold voltage of the driving element is shifted as the accumulated driving time of the pixels becomes longer, so that compensation of the threshold voltage of the driving element may be insufficient only with internal compensation.

The timing controller 130 may drive the pixels in the internal compensation driving mode until the accumulated driving time of the pixels reaches the preset compensation mode change time point according to the preset prediction model, while it may apply the internal compensation driving mode and the external compensation mode together after the compensation mode change time point. For example, the pixels in the preset sensing mode may be driven in the external compensation mode after the compensation mode change time point, and the pixels in the display mode other than the sensing mode may be driven in the internal compensation mode. The sensing mode may be set to a power on sequence immediately after the power of the display device is turned on, a power off sequence immediately after the power of the display device is turned off, and a vertical blank period in which pixel data of an input image is not received between frame periods of the display mode. Also, the sensing mode may be arbitrarily activated according to a user selection. The display mode may be set to an active period excluding a vertical blank period from a frame period in which pixel data is written into pixels. In the display mode, during the active period in every frame period, pixel lines are sequentially scanned to write pixel data to the pixels.

Figure 5:
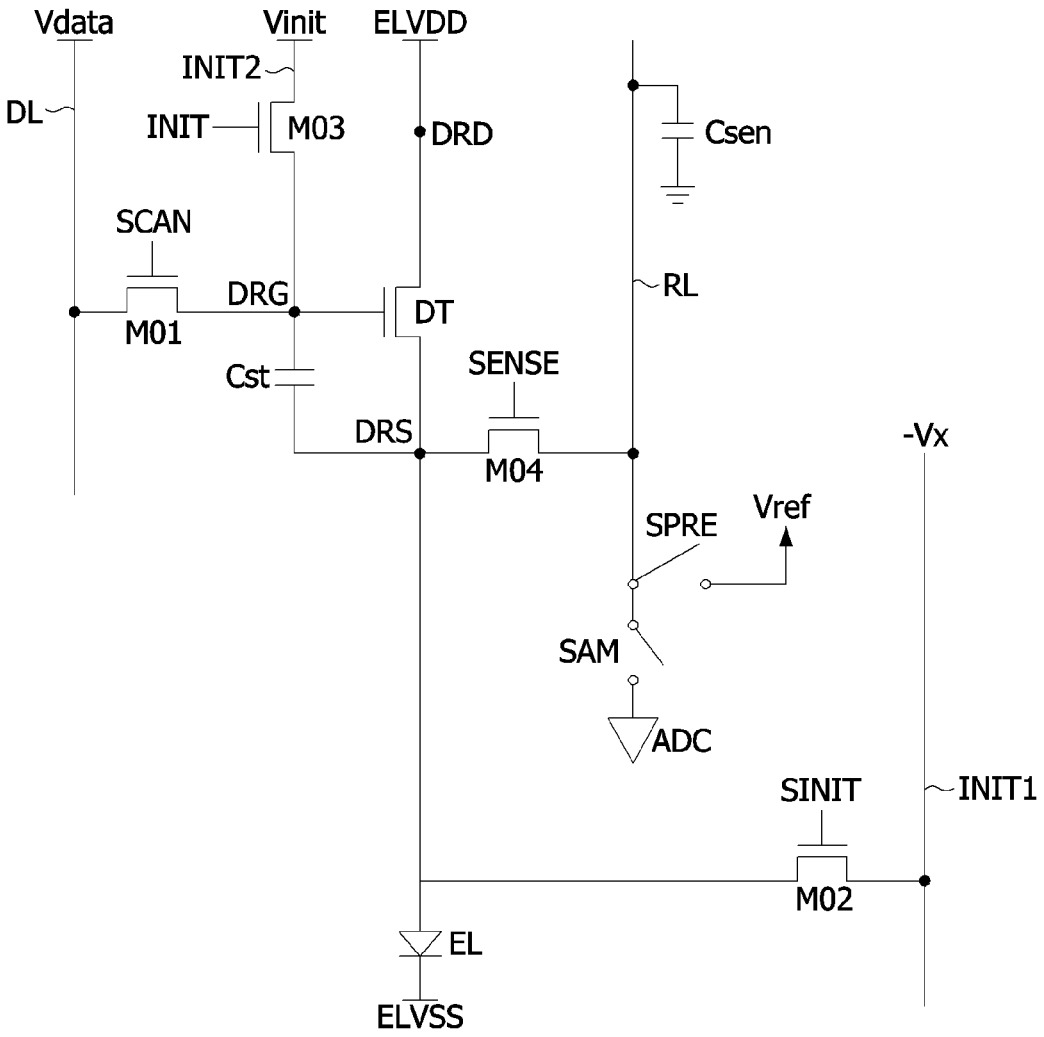
FIG. 5 is a circuit diagram showing a pixel circuit according to a second embodiment of this disclosure.
Figure 6:
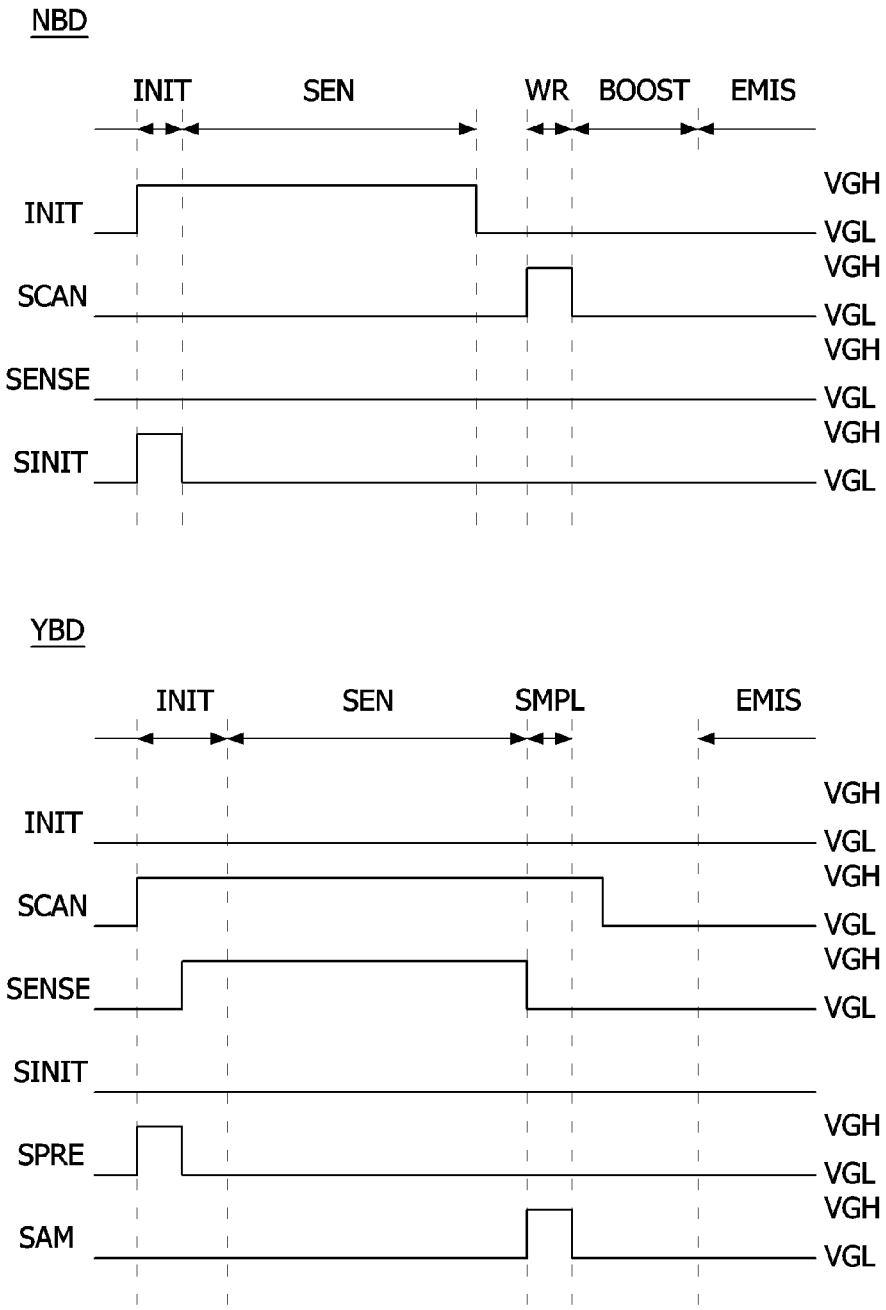
FIG. 6 is a waveform diagram showing a gate signal applied to the pixel circuit shown in FIG. 5 according to the second embodiment of this disclosure.

FIG. 5 is a circuit diagram showing a pixel circuit according to a second embodiment of this disclosure. FIG. 6 is a waveform diagram showing a gate signal applied to the pixel circuit shown in FIG. 5 according to the second embodiment of this disclosure. In FIG. 6, 'NBD' is an internal compensation mode, and 'YBD' is an external compensation mode according to the second embodiment. A detailed description of a circuit configuration substantially identical to that of the pixel circuit of the above-described embodiment in the pixel circuit shown in FIG. 5 will be omitted.

Referring to FIGS. 5 and 6, the pixel circuit includes a light emitting element EL, a driving element DT for supplying electric current to the light emitting element EL, a plurality of switch elements M01 to M04, and a capacitor Cst. In this pixel circuit, the driving element DT and the switch elements M01 to M04 may be implemented as n-channel oxide TFTs.

A constant voltage, such as a pixel driving voltage ELVDD, a pixel ground voltage supply voltage ELVSS, a first initialization voltage −Vx, a second initialization voltage Vinit, a reference voltage Vref, or the like, is applied to the pixel circuit. The pixel driving voltage ELVDD is higher than the pixel ground voltage supply voltage ELVSS. The pixel ground voltage supply voltage ELVSS is set to 0 V or the ground voltage GND. The second initialization voltage Vinit is set to a voltage higher than the first initialization voltage −Vx and the pixel ground voltage supply voltage ELVSS. The first initialization voltage −Vx may be set to a negative voltage lower than the pixel ground voltage supply voltage ELVSS. The reference voltage Vref may be set to be higher than the pixel ground voltage supply voltage ELVSS and lower than the second initialization voltage Vinit. The gate-on voltage VGH may be set to a voltage higher than the pixel driving voltage ELVDD. The gate-off voltage VGL may be set to a voltage lower than the pixel ground voltage supply voltage ELVSS.

The gate driver 120 may include a first shift register sequentially outputting the first initialization pulses SINITs, a second shift register sequentially outputting the second initialization pulses INITs, a third shift register that sequentially outputs the scan pulses SCANs, and a fourth shift register that sequentially outputs sensing pulses SENSEs.

This pixel circuit can be driven in the internal compensation mode NBD and the external compensation mode YBD.

In the internal compensation mode NBD, the driving period of the pixel circuit may be divided into an initialization stage INIT, a sensing stage SEN, an addressing stage WR, a boosting stage BOOST, and a light emitting stage EMIS. In the initialization stage INIT, the second and third nodes DRG and DRS and the capacitor Cst of the pixel circuit are initialized, and the driving element DT is turned on. In the sensing stage SEN, when the voltage of the third node DRS rises and the gate-source voltage Vgs of the driving element DT becomes lower than the threshold voltage Vth, the driving element DT is turned off. The threshold voltage Vth of the driving element DT, which has been sampled when the driving element DT is turned off in the sensing stage SEN, is stored. When the data voltage Vdata is applied to the second node DRG in the addressing stage WR, the gate voltage of the driving element DT is changed to the data voltage Vdata compensated by the threshold voltage Vth. The voltages of the second node DRG and the third node DRS floating in the boosting stage BOOST rise, so that a capacitor connected between both ends of the light emitting element EL is charged. In the light emitting stage EMIS, the driving element DT generates an electric current for driving the light emitting element EL according to the gate-source voltage Vgs.

The first initialization pulse SINIT is generated as the gate-on voltage VGH in the addressing stage WR, while it is the gate-off voltage VGL in the initialization stage INIT, the sensing stage SEN, the boosting stage BOOST, and the light emitting stage EMIS. The second initialization pulse INIT is generated as the gate-on voltage VGH in the initialization stage INIT and the sensing stage SEN. The second initialization pulse INIT is the gate-off voltage VGL in the addressing stage WR, the boosting stage BOOST, and the light emitting stage EMIS. The scan pulse SCAN is synchronized with the data voltage Vdata of the pixel data, and is generated as the gate-on voltage VGH in the addressing stage WR. The scan pulse SCAN is the gate-off voltage VGL in the initialization stage INIT, the sensing stage SEN, the boosting stage BOOST, and the light emitting stage EMIS.

The anode electrode of the light emitting element EL may be connected to the third node DRS, and the cathode electrode thereof may be connected to the VS S line to which the pixel ground voltage supply voltage ELVSS is applied. The driving element DT includes a gate electrode connected to the second node DRG, a first electrode connected to the first node DRD to which the pixel driving voltage ELVDD is applied, and a third electrode connected to the third node DRS. The capacitor Cst is connected between the second node DRG and the third node DRS.

The first switch element M01 includes a gate electrode connected to the first gate line to which the scan pulse SCAN is applied, a first electrode connected to the data line DL to which the data voltage Vdata is applied, and a second electrode connected to the second node DRG. The second switch element M02 includes a gate electrode connected to a second gate line to which the first initialization pulse SINIT is applied, a first electrode connected to the third node DRS, and a second electrode connected to an INIT1 line to which the first initialization voltage −Vx is applied. The third switch element M03 includes a gate electrode connected to a third gate line to which the second initialization pulse INIT is applied, a first electrode connected to the INIT2 line to which the second initialization voltage Vinit is applied, and a second electrode connected to the second node DRG.

The fourth switch element M04 includes a gate electrode connected to a fourth gate line to which the sensing pulse SENSE is applied, a first electrode connected to the third node DRS, and a second electrode connected to the REF line RL to which the reference voltage Vref is applied. In the internal compensation mode NBD, the sensing pulse SENSE maintains the gate-off voltage VGL. Accordingly, the fourth switch element M04 is in an off state in the internal compensation mode. As a result, in the internal compensation mode NBD, the third node DRS is electrically isolated from the REF line RL.

In the external compensation mode YBD, the driving period of the pixel circuit may be divided into an initialization stage INIT, a sensing stage SEN, a sampling stage SMPL, and a light emitting stage EMIS. A boosting stage may be set between the sampling stage SMPL and the light emitting stage EMIS. In the boosting stage, the gate signals SCAN, SNIT, INIT, and SENSE are the gate-off voltages VGLs.

The first and second initialization pulses SINIT and INIT maintain the gate-off voltage VGL in the external compensation mode YBD. Accordingly, in the external compensation mode YBD, since the second and third switch elements M02 and M03 maintain an off state, the second node DRG is electrically isolated from the INIT2 line, and the third node (DRS) is electrically isolated from the INIT1 line.

The scan pulse SCAN is generated as a gate-on voltage VGH in the initialization step INIT, the sensing stage SEN, and the sampling stage SMPL in the external compensation mode YBD. The scan pulse SCAN is the gate-off voltage VGL in the light emitting stage EMIS in the external compensation mode YBD.

The sensing pulse SENSE is generated as the gate-on voltage VGH in the initialization stage INIT and the sensing stage SEN in the external compensation mode YBD. The sensing pulse SENSE is a gate-off voltage in the sampling stage SMPL and the light emitting stage EMIS in the external compensation mode YBD. The sensing pulse SENSE rises to the gate-on voltage VGH later than a rising edge at which the scan pulse SCAN is inverted to the gate-on voltage VGH, and then the sensing pulse SENSE falls to the gate-off voltage VGL before a falling edge at which the scan pulse SCAN is inverted to the gate-off voltage VGL. Accordingly, the fourth switch element M04 is turned on in the initialization stage INIT and the sensing stage SEN in the external compensation mode YBD to supply the reference voltage Vref to the third node DRS.

The reference voltage switch element SPRE and the sampling switch element SAM may be connected to the REF line RL to which the reference voltage Vref is applied. The reference voltage switch element SPRE and the sampling switch element SAM are turned on/off under the control of the timing controller 130. The reference voltage switch element SPRE is turned on in the initialization stage INIT to supply the reference voltage Vref to the REF line RL. After the reference voltage switch element SPRE is turned off in the initialization stage INIT, the fourth switch element M04 may be turned on in response to the sensing pulse SENSE. The sampling switch element SAM is turned on in the sampling stage SMPL to connect the REF line RL to the ADC.

The reference voltage switch element SPRE, the sampling switch element SAM, and the ADC may be embedded in a drive integrated circuit (IC) in which the data driver 110 is integrated.

Figure 7:
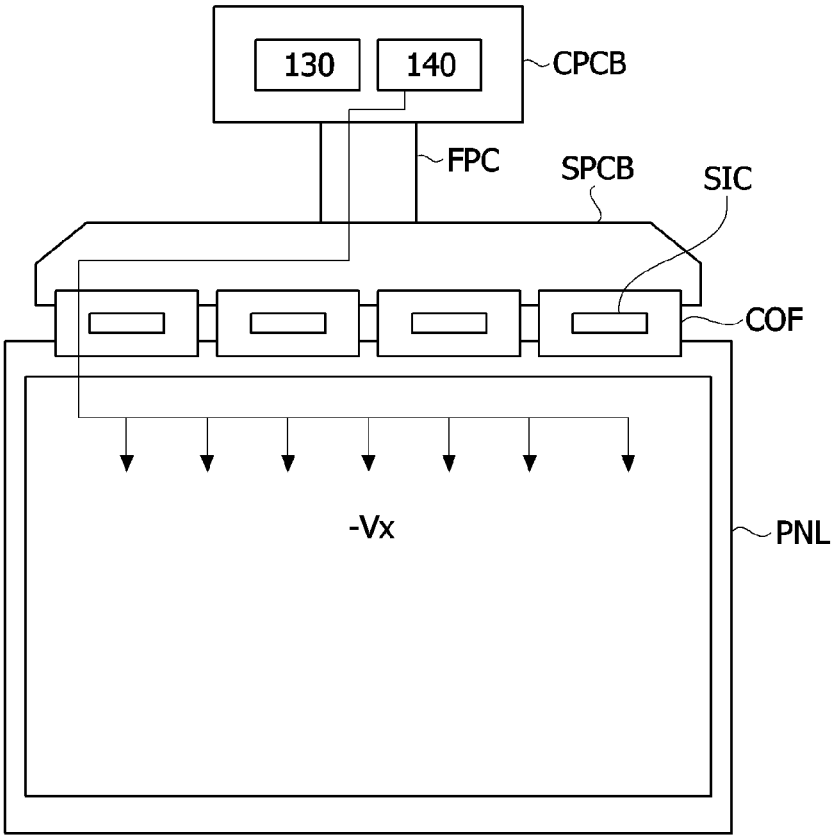
FIG. 7 is a diagram showing a path through which a first initialization voltage is applied to pixels according to an embodiment of this disclosure.
Figure 8:
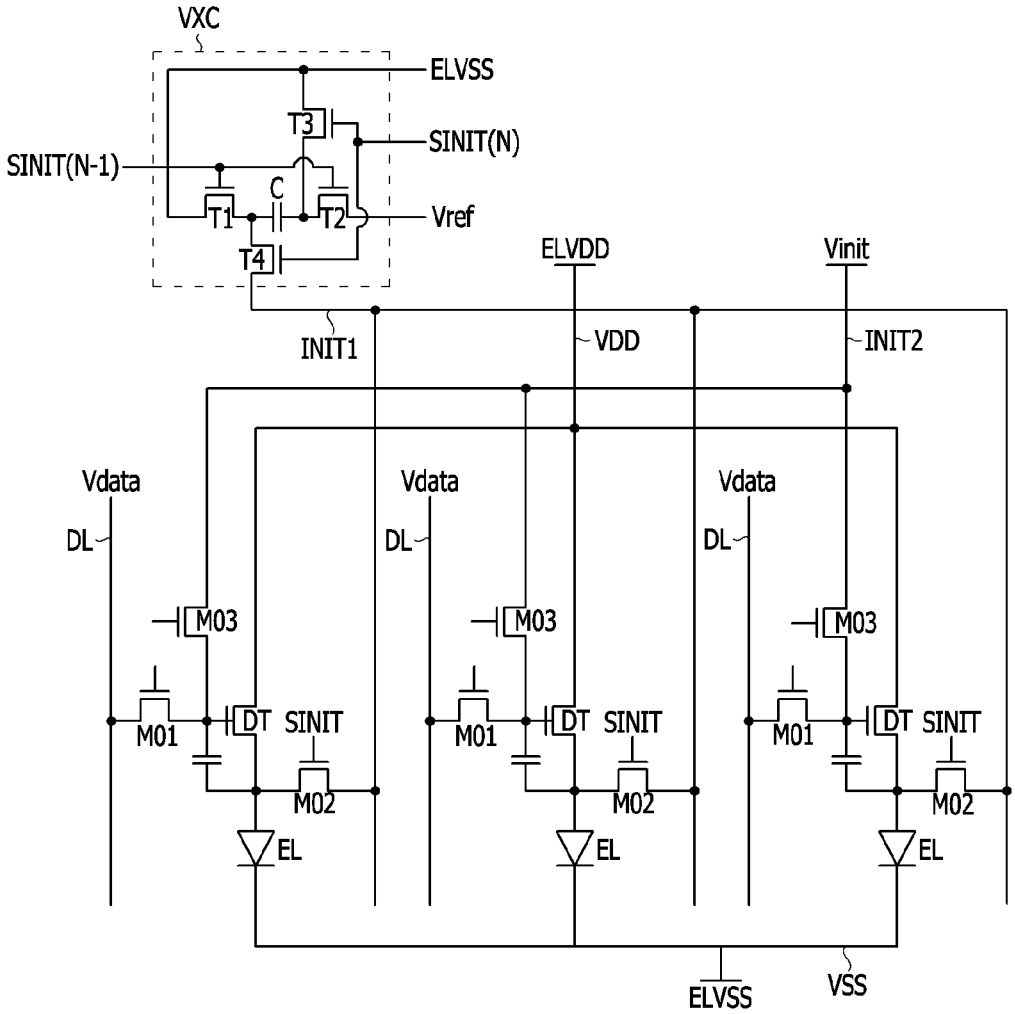
FIG. 8 is a circuit diagram showing a negative voltage generating circuit according to an embodiment of this disclosure.
Figure 9:
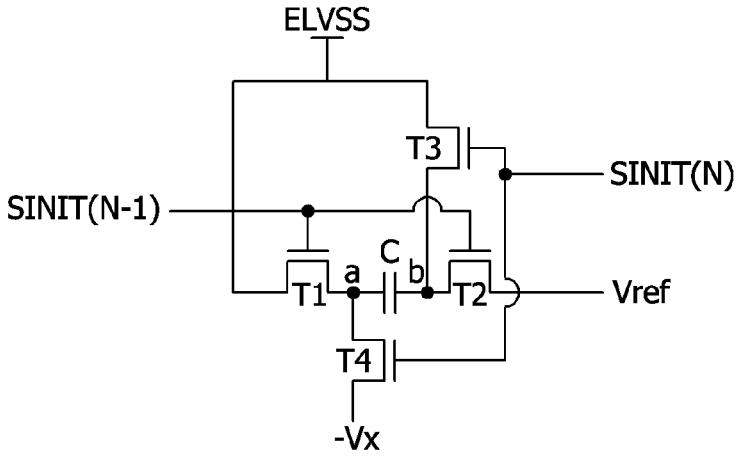
FIG. 9 is an enlarged circuit diagram of the negative voltage generating circuit shown in FIG. 8 according to an embodiment of this disclosure.

FIG. 7 is a diagram showing a path through which a first initialization voltage −Vx is applied to pixels according to an embodiment of this disclosure.

Referring to FIG. 7, the data driver 110 may be integrated in each of one or more drive ICs SIC. A chip on film (COF) may be adhered to the display panel PNL. The drive IC (SIC) is mounted on the COF. The COF is connected between the source PCB (printed circuit board, SPCB) and the display panel PNL, and output terminals of the drive IC (SIC) are electrically connected to the display panel 100.

The timing controller 130 and the power supply 140 may be mounted on a control PCB (CPCB). The control PCB (CPCB) may be connected to the source PCB (SPCB) through a flexible circuit film, for example, a flexible printed circuit (FPC). At least a portion of the power supply 140 may be disposed on the source PCB (SPCB).

The constant voltages outputted from the power supply 140 may be supplied to the display panel PNL via the source PCB SPCB and the dummy wires of the COF. The first initialization voltage −Vx may be generated from the negative voltage generating circuit of the power supply 140 formed on the control PCB (CPCB) or the source PCB (SPCB), and may be supplied to the pixels of the display panel PNL through the dummy wires of the COF. The dummy wires of the COF are wires formed outside the drive IC (SIC) on the COF.

Figure 10:
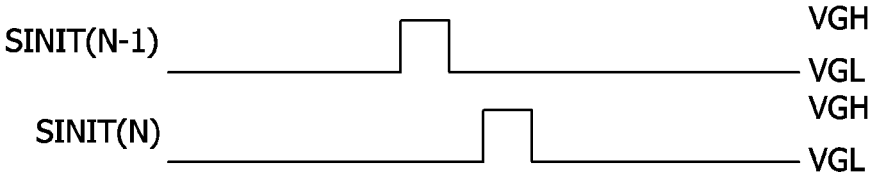
FIG. 10 is a waveform diagram showing an example of an N−1th gate pulse and an Nth gate pulse inputted to a negative voltage generating circuit shown in FIG. 8 according to an embodiment of this disclosure.

FIGS. 8, 9, 11 and 12 are circuit diagrams showing a negative voltage generating circuit VXC according to an embodiment of this disclosure. FIG. 10 is a waveform diagram showing an example of an N−1th (N is a positive integer) gate pulse and an Nth gate pulse inputted to a negative voltage generating circuit according to an embodiment of this disclosure.

Referring to FIGS. 8 to 12, the negative voltage generating circuit VXC generates the first initialization voltage −Vx in response to an N−1th gate pulse and an Nth gate pulse. Here, the gate pulse may be a gate pulse that controls a switch element which applies the first initialization voltage −Vx to the third node DRS of the pixel circuit. For example, in the pixel circuit shown in FIGS. 3 and 5, the gate pulse may be the first initialization pulse SINIT, or a separate gate pulse synchronized with the first initialization pulse SINIT. The N−1th gate pulse and the Nth gate pulse may be sequentially generated from the shift register of the gate driver 120 as shown in FIG. 10. Hereinafter, "N−1th gate pulse" and "Nth gate pulse" are respectively described as "N−1th initialization pulse [SINIT(N−1)]" and "Nth initialization pulse [SINIT(N)]", but are not limited thereto.

The negative voltage generating circuit VXC is formed in the circuit layer 12 of the display panel PNL, and may be disposed in a bezel region outside the pixel array or in the pixel array. In addition, the negative voltage generating circuit VXC may be embedded in the drive IC (SIC). The negative voltage generating circuit VXC may be commonly connected to two or more pixel circuits. The pixel circuits connected to the negative voltage generating circuit VXC may be disposed on the same pixel line to share the gate lines and the INIT1 line. In other words, the plurality of pixels may be connected to one negative voltage generating circuit VXC, so that they may receive the first initialization voltage −Vx generated from the negative voltage generating circuit VXC.

The negative voltage generating circuit VXC includes first to fourth switch elements T1 to T4 and a capacitor C. When the negative voltage generating circuit VXC is formed in the circuit layer 12 of the display panel PNL, the switch elements T1 to T4 may be implemented as n-channel oxide TFT.

The pixel ground voltage supply voltage ELVSS and the reference voltage Vref are supplied to the negative voltage generating circuit VXC. The pixel ground voltage supply voltage ELVSS is 0 V or the ground voltage GND. The reference voltage Vref may be a positive voltage higher than the pixel ground voltage supply voltage ELVSS, for example, 1 V.

The capacitor C is connected between the A node (a) and the B node (b). The first switch element T1 is turned on according to the gate-on voltage VGH of the N−1th initialization pulse [SINIT(N−1),] and connects the VSS node, to which the pixel ground voltage supply voltage ELVSS is applied, to the A node (a). The VSS node may be connected to the VSS line VSS. The first switch element T1 includes a gate electrode to which an N−1th initialization pulse [SINIT (N−1)] is applied, a first electrode connected to the VSS node, and a second electrode connected to the A node (a).

The second switch element T2 is turned on according to the gate-on voltage VGH of the N−1th initialization pulse [SINIT(N−1)], so that it connects the B node (b) to the REF node to which the reference voltage Vref is applied. The REF node may be connected to the REF line. The second switch element T2 includes a gate electrode to which an N−1th initialization pulse [SINIT(N−1)] is applied, a first electrode connected to the B node (b), and a second electrode connected to the REF node.

The third switch element T3 is turned on according to the gate-on voltage VGH of the Nth initialization pulse [SINIT (N)] to connect the VSS node, to which the pixel ground voltage supply voltage ELVSS is applied, to the B node (b). The third switch element T3 includes a gate electrode to which the Nth initialization pulse [SINIT(N)] is applied, a first electrode connected to the VSS node, and a second electrode connected to the B node (b).

The fourth switch element T4 is turned on according to the gate-on voltage VGH of the Nth initialization pulse [SINIT(N)] to connect the A node (a) to the INIT1 line. The negative voltage output through the fourth switch element T4, that is, the first initialization voltage −Vx is supplied to the pixels through the INIT1 line. The fourth switch element T4 includes a gate electrode to which the Nth initialization pulse [SINIT(N)] is applied, a first electrode connected to the A node (a), and a second electrode connected to the INIT1 line.

Figure 11:
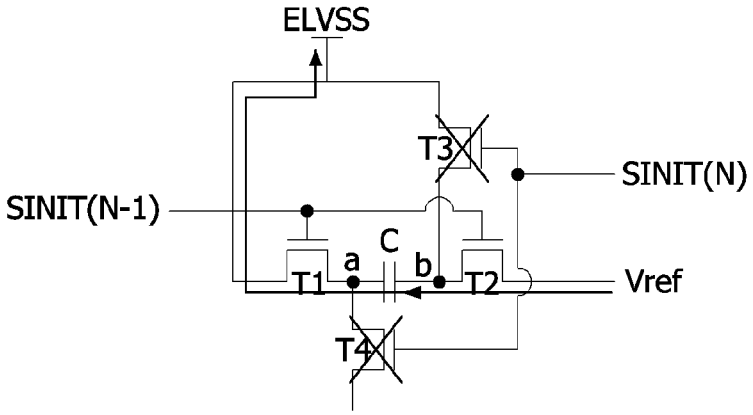
FIGS. 11 and 12 are circuit diagrams showing the operation of the negative voltage generating circuit shown in FIG. 8 in different stages according to an embodiment of this disclosure.

When the N−1th initialization pulse [SINIT(N−1)] is inputted to the negative voltage generating circuit VXC, as shown in FIG. 11, the first and second switch elements T1 and T2 turn-on, while the third and fourth switch elements T3 and T4 are turned off. At this time, ELVSS=0 V is applied to the A node (a), Vref=1 V for example is applied to the B node (b), and thus 1 V is stored in the capacitor C.

Figure 12:
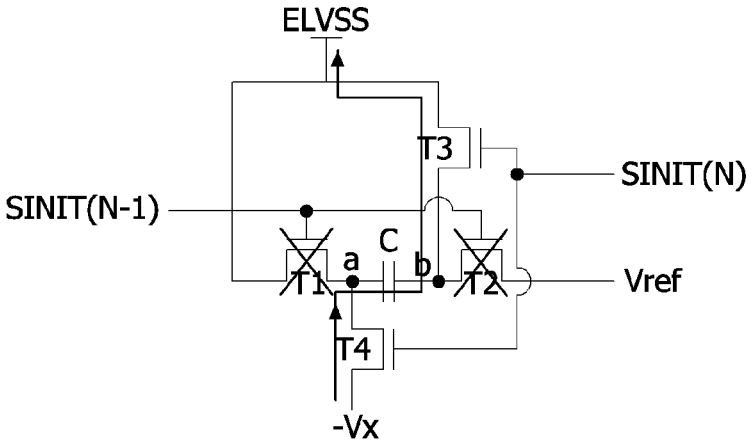

Subsequently, when the Nth initialization pulse [SINIT (N)] is inputted to the negative voltage generating circuit VXC, the third and fourth switch elements T3 and T4 are turned on as shown in FIG. 12, while the first and second switch elements T1 and T2 are turned off. At this time, since ELVSS=0 V is applied to the B node (b), the A node (a) changes to −1 V for example. Accordingly, when the Nth initialization pulse [SINIT(N)] is generated as the gate-on voltage VGH, the negative first initialization voltage −Vx is applied to the pixels through the INIT1 line.

The objects to be achieved by the present disclosure, the means for achieving the objects, and effects of the present disclosure described above do not specify essential features of the claims, and thus, the scope of the claims is not limited to the disclosure of the present disclosure.

Although the embodiments of the present disclosure have been described in more detail with reference to the accompanying drawings, the present disclosure is not limited thereto and may be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A pixel circuit comprising:

a driving element including a first electrode connected to a first node to which a pixel driving voltage is applied, a gate electrode connected to a second node, and a third electrode connected to a third node, the driving element configured to supply an electric current;

a light emitting element configured to receive the electric current supplied by the driving element, the light emitting element including an anode electrode connected to the third node, and a cathode electrode to which a pixel ground voltage is applied;

a first switch element configured to supply a data voltage to the second node in response to a scan pulse;

a second switch element configured to supply a first initialization voltage to the third node in response to a first initialization pulse, the first initialization voltage set to a negative voltage that is less than the pixel ground voltage supply voltage;

a third switch element configured to supply a second initialization voltage that is greater than the first initialization voltage to the second node in response to a second initialization pulse; and a capacitor connected between the second node and the third node, wherein a driving period of the pixel circuit includes an initialization stage, a sensing stage, an addressing stage, a boosting stage, and a light emitting stage, wherein the first switching element to the third switch element are turned on according to a gate-on voltage, and turned off according to a gate-off voltage, wherein the first initialization pulse is generated as the gate-on voltage in the initialization stage, and as the gate-off voltage in the sensing stage, the addressing stage, the boosting stage, and the light emitting stage, wherein the second initialization pulse is generated as the gate-on voltage in the initialization stage and the sensing stage, and as the gate-off voltage in the addressing stage, the boosting stage, and the light emitting stage, and wherein the scan pulse is generated as the gate-on voltage in the addressing stage, and as the gate-off voltage in the initialization stage, the sensing stage, the boosting stage, and the light emitting stage.

2. The pixel circuit of claim 1, wherein the pixel ground voltage supply voltage is zero volts.

3. The pixel circuit of claim 1, wherein the first switch element includes a gate electrode of the first switch element to which the scan pulse is applied, a first electrode of the first switch element to which the data voltage is applied, and a second electrode of the first switch element that is connected to the second node, wherein the second switch element includes a gate electrode of the second switch element to which the first initialization pulse is applied, a first electrode of the second switch element that is connected to the third node, and a second electrode of the second switch element to which the first initialization voltage is applied, and wherein the third switch element includes a gate electrode of the third switch element to which the second initialization pulse is applied, a first electrode of the third switch element to which the second initialization voltage is applied, and a second electrode of the third switch element that is connected to the second node.

4. A pixel circuit comprising:

a driving element including a first electrode connected to a first node to which a pixel driving voltage is applied, a gate electrode connected to a second node, and a third electrode connected to a third node, the driving element configured to supply an electric current;

a light emitting element configured to receive the electric current supplied by the driving element, the light emitting element including an anode electrode connected to the third node, and a cathode electrode to which a pixel ground voltage is applied;

a first switch element configured to supply a data voltage to the second node in response to a scan pulse;

a second switch element configured to supply a first initialization voltage to the third node in response to a first initialization pulse, the first initialization voltage set to a negative voltage that is less than the pixel ground voltage supply voltage;

a third switch element configured to supply a second initialization voltage that is greater than the first initialization voltage to the second node in response to a second initialization pulse;

a fourth switch element configured to supply to the third node a reference voltage set to a voltage greater than the pixel ground voltage supply voltage and less than the second initialization voltage responsive to a sensing pulse; and a capacitor connected between the second node and the third node.

5. The pixel circuit of claim 4, wherein the fourth switch element includes a gate electrode of the fourth switch element to which the sensing pulse is applied, a first electrode of the fourth switch element that is connected to the third node, and a second electrode of the fourth switch element to which the reference voltage is applied.

6. The pixel circuit of claim 5, wherein a driving period of the pixel circuit includes a first initialization stage, a first sensing stage, an addressing stage, a boosting stage, and a first light emitting stage in an internal compensation mode, wherein the first switching element to the third switch element are turned on according to a gate-on voltage, and turned off according to a gate-off voltage, wherein the first initialization pulse is generated as the gate-on voltage in the first initialization stage, and as the gate-off voltage in the first sensing stage, the addressing stage, the boosting stage, and the first light emitting stage, wherein the second initialization pulse is generated as the gate-on voltage in the first initialization stage and the first sensing stage, and as the gate-off voltage in the addressing stage, the boosting stage, and the first light emitting stage, and wherein the scan pulse is generated as the gate-on voltage in the addressing stage, and as the gate-off voltage in the first initialization stage, the first sensing stage, the boosting stage, and the first light emitting stage.

7. The pixel circuit of claim 6, wherein the driving period of the pixel circuit includes a second initialization stage, a second sensing stage, a sampling stage, and a second light emitting stage in an external compensation mode, wherein the first initialization pulse and the second initialization pulse maintain the gate-off voltage in the external compensation mode, wherein the scan pulse is generated as the gate-on voltage in the second initialization stage, the second sensing stage, and the sampling stage, and as the gate-off voltage in the second light emitting stage, and wherein the sensing pulse is generated as the gate-on voltage in the second initialization stage and the second sensing stage, and as the gate-off voltage in the sampling stage and the second light emitting stage.

8. A display device comprising:

a display panel including a plurality of data lines, a plurality of gate lines crossing the data lines, a plurality of power lines, and a plurality of pixel circuits connected to the plurality of data lines, the plurality of gate lines, and the plurality of power lines;

a data driver configured to supply a data voltage of pixel data to the plurality of data lines; and a gate driver configured to supply a gate signal to the plurality of gate lines, wherein the gate signal includes a first initialization pulse, a second initialization pulse, and a scan pulse, and wherein each of the plurality of pixel circuits includes:

a driving element including a first electrode connected to a first node to which a pixel driving voltage is applied, a gate electrode connected to a second node, and a third electrode connected to a third node, the driving element configured to supply an electric current;

a light emitting element configured to receive the electric current, the light emitting element including an anode electrode connected to the third node, and a cathode electrode to which a pixel ground voltage supply voltage is applied;

a first switch element configured to supply the data voltage to the second node in response to the scan pulse;

a second switch element configured to supply a first initialization voltage to the third node in response to the first initialization pulse, the first initialization voltage set to a negative voltage that is less than the pixel ground voltage supply voltage;

a third switch element configured to supply a second initialization voltage that is greater than the first initialization voltage to the second node in response to the second initialization pulse; and a capacitor connected between the second node and the third node, wherein a driving period of the pixel circuit includes an initialization stage, a sensing stage, an addressing stage, a boosting stage, and a light emitting stage, wherein the first switch element to the third switch element are turned on according to a gate-on voltage, and turned off according to a gate-off voltage, wherein the first initialization pulse is generated as the gate-on voltage in the initialization stage, and as the gate-off voltage in the sensing stage, the addressing stage, the boosting stage, and the light emitting stage, wherein the second initialization pulse is generated as the gate-on voltage in the initialization stage and the sensing stage, and as the gate-off voltage in the addressing stage, the boosting stage, and the light emitting stage, and wherein the scan pulse is generated as the gate-on voltage in the addressing stage, and as the gate-off voltage in the initialization stage, the sensing stage, the boosting stage, and the light emitting stage.

9. The display device of claim 8, wherein the pixel ground voltage supply voltage is zero volts.

10. The display device of claim 8, further comprising:

a negative voltage generating circuit configured to generate the first initialization voltage, wherein the negative voltage generating circuit is disposed on the display panel.

11. The display device of claim 10, wherein the negative voltage generating circuit includes:

a second capacitor connected between a fourth node and a fifth node;

a first switch element of the negative voltage generating circuit including a gate electrode of the first switch element to which an N−1th gate pulse is applied, a first electrode of the first switch element to which the pixel ground voltage supply voltage is applied, and a second electrode of the first switch element connected to a node A, wherein N is a positive integer;

a second switch element of the negative voltage generating circuit including a gate electrode of the second switch element to which the N−1th gate pulse is applied, a first electrode of the second switch element connected to the fifth node, and a second electrode of the second switch element to which a reference voltage set to a positive voltage greater than the pixel ground voltage supply voltage is applied;

a third switch element of the negative voltage generating circuit including a gate electrode of the third switch element to which an Nth gate pulse is applied, a first electrode of the third switch element to which the pixel ground voltage supply voltage is applied, and a second electrode of the third switch element connected to the fifth node; and a fourth switch element of the negative voltage generating circuit including a gate electrode of the third switch element to which the Nth gate pulse is applied, a first electrode of the third switch element that is connected to the fourth node, and a second electrode of the third switch element that is connected to two or more pixel circuits to be connected to a power line to which the first initialization voltage is applied.

12. The display device of claim 11, wherein the gate pulse is the first initialization pulse.

13. The display device of claim 11, wherein each of the driving element and the first switch element to the third switch element of each pixel circuit and the first switch element to the fourth switch element of the negative voltage generating circuit includes an n-channel transistor.

* * * * *